US011806712B2

(12) United States Patent
Jung et al.

(10) Patent No.: US 11,806,712 B2
(45) Date of Patent: Nov. 7, 2023

(54) MICROFLUIDIC MIXER AND MICROFLUIDIC DEVICE COMPRISING THE SAME

(71) Applicant: UIF (University Industry Foundation), Yonsei University, Seoul (KR)

(72) Inventors: Hyo Il Jung, Seoul (KR); Kyung A Hyun, Gyeonggi-do (KR); Sun Young Park, Seoul (KR); Hogyeong Gwak, Seoul (KR); Seung Il Kim, Seoul (KR)

(73) Assignee: UIF (UNIVERSITY INDUSTRY FOUNDATION), YONSEI UNIVERSITY, Seoul (KR)

( * ) Notice: Subject to any disclaimer, the term of this patent is extended or adjusted under 35 U.S.C. 154(b) by 9 days.

(21) Appl. No.: 17/369,302

(22) Filed: Jul. 7, 2021

(65) Prior Publication Data

US 2022/0032303 A1 Feb. 3, 2022

(30) Foreign Application Priority Data

Jul. 8, 2020 (KR) ..... 10-2020-0083881

(51) Int. Cl.
*B01L 3/00* (2006.01)

(52) U.S. Cl.
CPC ... *B01L 3/502746* (2013.01); *B01L 2200/027* (2013.01); *B01L 2400/086* (2013.01)

(58) Field of Classification Search
None
See application file for complete search history.

(56) References Cited

U.S. PATENT DOCUMENTS 10,073,024 B2 * 9/2018 Nagrath ..... B01L 3/502761
11,555,805 B2 * 1/2023 Beals ..... B01F 25/4331
2007/0263477 A1 * 11/2007 Sudarsan ..... B01F 25/433 366/3

(Continued)

FOREIGN PATENT DOCUMENTS

CN 108855265 A * 11/2018 ..... B01F 33/301
KR 101432729 B1 8/2014
KR 101736797 B1 5/2017

OTHER PUBLICATIONS

Kockmann et al., Silicon microstructures for high throughput mixing devices, 2006, Microfluid Nanofluid, 2, p. 327-335. (Year: 2006).*

(Continued)

*Primary Examiner* — Lore R Jarrett
(74) *Attorney, Agent, or Firm* — Tarolli, Sundheim, Covell & Tummino, LLP

(57) ABSTRACT

The present invention relates to a microfluidic mixer and a microfluidic device including the same, and in the microfluidic mixer according to the present invention, a disk-shaped mixing unit with double U-shaped protruding portions formed therein can be continuously provided along a microchannel, thereby increasing collisions of samples to improve the binding efficiency thereof and shorten the binding time. Furthermore, the microfluidic device according to the present invention can detect a target material at high speed even at a high flow rate by including the microfluidic mixer, and thus can be usefully utilized for early diagnosis and prognosis diagnosis of a disease such as cancer.

10 Claims, 12 Drawing Sheets

(56) References Cited

U.S. PATENT DOCUMENTS

| | | | | |
|---|---|---|---|---|
| 2012/0300576 | A1* | 11/2012 | Li | B01F 25/433 366/338 |
| 2013/0091933 | A1* | 4/2013 | Tsukada | G01N 30/02 73/61.55 |
| 2013/0164779 | A1* | 6/2013 | Kelley | G01N 33/5094 435/39 |
| 2014/0241110 | A1* | 8/2014 | Igata | B01L 3/5027 366/340 |
| 2014/0377145 | A1* | 12/2014 | Govyadinov | B01F 25/50 422/505 |
| 2017/0065978 | A1* | 3/2017 | Zhao | B01F 33/30 |
| 2019/0070571 | A1* | 3/2019 | Jackson | B01F 33/30 |

OTHER PUBLICATIONS

Sha, J., A Multi-channel Micro-reaction Chip, Microfluidic Mixing Method And Preparation Method Thereof, Jul. 19, 2018, Translation, pp. 1-8.*

"A Review on Micromixers" by Gaozhe Cai et al., Micromachines 2017, 8, 274.

* cited by examiner

*Bound exosome R1 ($N_{exo}$= $10^7$), *Bound exosome R2 ($N_{exo}$= $10^8$), *Bound exosome R3 ($N_{exo}$= $10^9$)

MICROFLUIDIC MIXER AND MICROFLUIDIC DEVICE COMPRISING THE SAME

CROSS-REFERENCE TO RELATED APPLICATION

This application claims priority to and the benefit of Korean Patent Application No. 10-2020-0083881, filed on Jul. 8, 2020, the disclosure of which is incorporated herein by reference in its entirety.

BACKGROUND

1. Field of the Invention

The present invention relates to a microfluidic mixer and a microfluidic device comprising the same.

2. Discussion of Related Art

Exosomes are the smallest extracellular vesicles (30 to 150 nm), and play a key role in intercellular signal transduction. Exosomes are present in human body fluids such as blood, saliva, and urine, and are very important for clinical research because analysis of proteins and genes in the exosomes can determine diagnostic and therapeutic methods. In general, patients with cancer have many exosomes derived from cancer cells. By analyzing such cancer-specific exosomes, it is possible to grasp the degree of cancer progression and obtain information necessary for cancer treatment.

However, although the concentration of total exosomes in blood is as high as about $1\times10^{10\ to\ 11}$/ml, cancer cell-derived exosomes that can be used for actual cancer diagnosis are only about 1% of the total exosomes. Therefore, there is a need for a technique capable of selectively concentrating and detecting only target cancer cell-derived exosomes from general exosomes having similar shapes and sizes.

As an exosome enrichment and detection method, an exosome isolation kit, ultracentrifugation, flow cytometry, and a nanotracking analysis, and the like have been used to date, but these methods have limitations that devices are expensive, only skilled researchers can operate these devices, and it also takes a lot of time to operate these devices. For this reason, a microfluidic chip capable of isolating exosomes is being actively developed worldwide.

SUMMARY OF THE INVENTION

An object of the present invention is to provide an ultra-high speed microfluidic mixer capable of shortening a binding time by efficiently binding a sample even at a high flow rate.

Another object of the present invention is to provide a microfluidic device capable of continuously detecting a target material at high speed even at a high flow rate based on excellent sample separation and concentration performance.

Still another object of the present invention is to provide a bioinformation analysis method for capturing a target material included in the body using the microfluidic device.

To achieve the above objects, the present invention provides a microfluidic mixer including: a first microchannel with a first inlet and a second inlet, through which a fluid is introduced, being formed on one side and a first outlet, through which the fluid is discharged, being formed on the other side; and at least two or more disk-shaped mixing units disposed between the first inlet and second inlet and the first outlet, in which a U-shaped first protruding portion and second protruding portion protruding from the disk surface are formed in the mixing unit and the first protruding portion is disposed inside a curved portion of the second protruding portion.

Further, the present invention provides a microfluidic device including: the microfluidic mixer; a second microchannel with a first outlet of the microfluidic mixer being connected to one side and a second outlet and a third outlet being formed on the other side; and at least two or more separating units disposed between the first outlet and the second inlet and outlet.

In addition, the present invention provides a bioinformation analysis method for capturing a target material included in the body.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
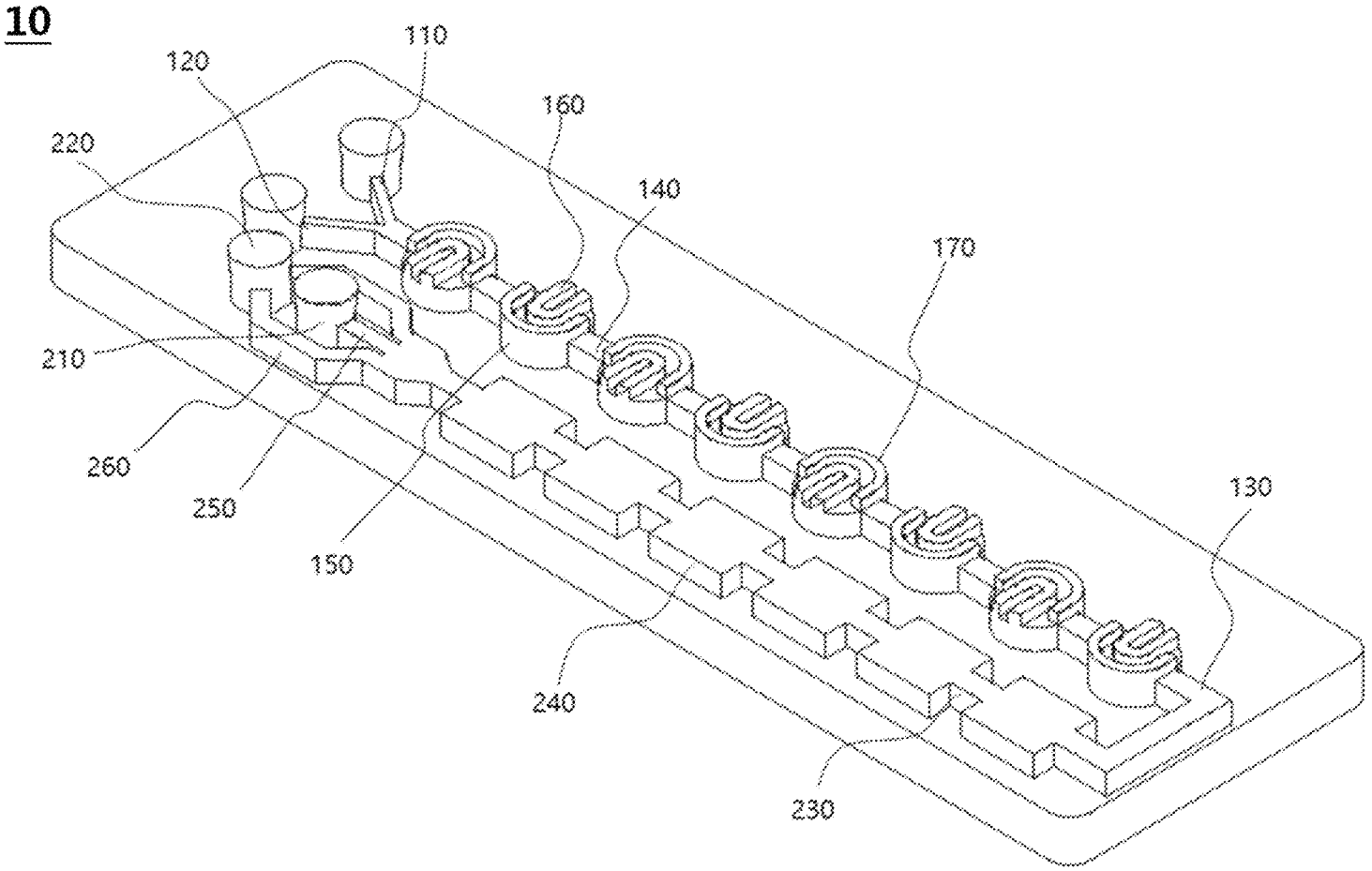
FIG. 1 illustrates a perspective view of a microfluidic mixer according to an exemplary embodiment of the present invention.

Since the technology described below may be modified into various forms and include various exemplary embodiments, specific exemplary embodiments will be illustrated in the drawings and described in detail. However, it is not intended to limit the technology described below to the specific exemplary embodiments, and it is to be understood to include all the changes, equivalents and substitutions included in the idea and technical scope of the technology described below.

Terms such as first, second, A, and B may be used to describe various components, but the components should not be limited by the terms, and the terms are used only for the purpose of distinguishing one component from another. For example, without departing from the scope of the technology described below, a first component may be called a second component, and similarly, the second component may also be called the first component. The term and/or includes a combination of a plurality of related listed items, or any item among the plurality of related listed items.

Regarding the terms used herein, it is to be understood that singular expressions include plural expressions unless the context clearly indicates otherwise, and that the terms such as "comprise" are intended to indicate that there is a feature, number, step, operation, component, part, or combination thereof described in the specification, but the terms do not exclude the possibility of the presence or the addition of one or more other features or numbers, steps, operations, components, components, or a combination thereof.

Before giving a detailed description of the drawings, it is intended to clarify that the classification of the constituent parts in the present specification is merely division according to the main function each constituent part is responsible for. That is, two or more constituent parts described below may be combined into one constituent part, or one constituent part may also be divided into two or more and provided for each more subdivided function. Moreover, of course, in addition to the main functions of each of the constituent parts described below are responsible for, each constituent part may perform some or all of the functions that other constituent parts are responsible for and some of the main functions that each constituent part is responsible for may be exclusively performed by the other constituent parts.

In addition, in performing a method or operation method, each process of the above method may differ from the specified order unless a specific order is explicitly stated in the context. That is, each process may be performed in the same manner as the specified order, may be performed at substantially the same time, or may be performed in the reverse order.

Hereinafter, the present invention will be described in more detail with reference to the accompanying drawings to help understanding of the present invention. However, the following embodiments are provided for easier understanding of the present invention, and the contents of the present invention are not limited by the following embodiments.

Figure 2:
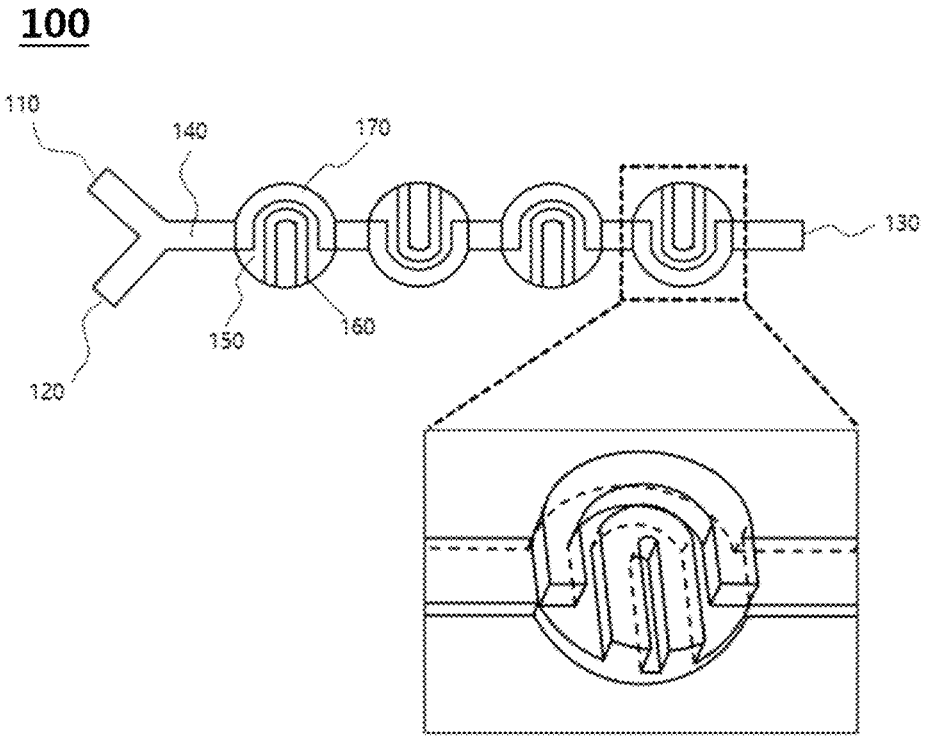
FIG. 2 illustrates a top view of the microfluidic mixer according to an exemplary embodiment of the present invention.

FIG. 1 illustrates a microfluidic device according to an exemplary embodiment of the present invention. FIG. 2 illustrates a top view of the microfluidic mixer according to an exemplary embodiment of the present invention.

As illustrated in FIGS. 1 and 2, a microfluidic mixer 100 according to the present invention includes: a first microchannel 140 with a first inlet 110 and a second inlet 120, through which a fluid is introduced, being formed on one side and a first outlet 130, through which the fluid is discharged, being formed on the other side; and at least two or more disk-shaped mixing units 150 disposed between the first inlet 110 and second inlet 120 and the first outlet 130, in which a U-shaped first protruding portion 160 and second protruding portion 170 protruding from the disk surface are formed in the mixing unit and the first protruding portion 160 is disposed inside a curved portion of the second protruding portion 170.

Different samples such as microbeads treated with a target material (exosomes, and the like) and a material that can bind to the target material (antibodies, and the like) may flow into the first inlet 110 and the second inlet 120. The samples that have flowed into the respective inlets 110, 120 flow out to the first outlet 130 through the mixing unit 150 along the first microchannel 140.

The mixing unit 150 may number two or more which may be disposed between the first inlet 110 and second 120 and the outlet 130, and may be formed in the form of a disk such that a fluid including a sample may continuously and smoothly flow.

The mixing unit 150 has a two-layer structure in which a U-shaped first protruding portion 160 and second protruding portion 170 are doubly formed at the disk surface. A disk-shaped space is formed in the lower portion of the mixing unit 150 which is directly connected to the first microchannel 140, and thus generates a vortex of the fluid which flows in, and the upper portion in which the U-shaped protruding space is formed (the first protruding portion and the second protruding portion) increases the number of collisions between the sample particles along the flow of the rising vortex. Even though the flow rate of the fluid flowing into the microfluidic mixer 100 is increased by the form of the mixing unit 150, it is possible to prevent the particles of the sample from being aligned and remarkably shorten the binding time between the samples.

As a specific exemplary embodiment, the mixing unit 150 may be disposed such that a direction in which both U-shaped ends of the first protruding portion and the second protruding portion face makes an angle of 10 to 170°, preferably 60 to 120°, and more preferably 80 to 100° with a direction in which the first microchannel extends, in order to increase the number of collisions between sample particles generated in the first protruding portion 160 and the second protruding portion 170.

As a specific exemplary embodiment, in the two or more mixing units 150, the first protruding portion 160 and the second protruding portion 170 of adjacent mixing units 150 may be disposed such that both the U-shaped ends face opposite directions. The first protruding portion 160 and the second protruding portion 170 are disposed such that both the U-shape ends face opposite directions, and thus serve to improve the mixing performance of the microfluidic mixer 100 by inducing the circulating flow of the vortex generated in the adjacent mixing unit 150. As described above, when the mixing units 150 are disposed, the fluid flows into the mixing unit 150, and then forms a vortex, and the samples collide and bind with each other at the first protruding portion 160 and the second protruding portion 170, and then a repetitive process may be smoothly and effectively performed by continuously connecting the flow of fluid moving to the next mixing unit 150.

As a specific exemplary embodiment, the length of the first microchannel 140 between the two or more mixing units 150 may be shorter than the diameter of the disk-shaped mixing unit 150. When the length of the first microchannel 150 is longer than the diameter of the disk-shaped mixing unit 150, a pressure drop of the fluid may occur, and accordingly, the flow in the mixing unit 150 is weakened, so that the mixing efficiency of the sample may deteriorate.

Figure 3:
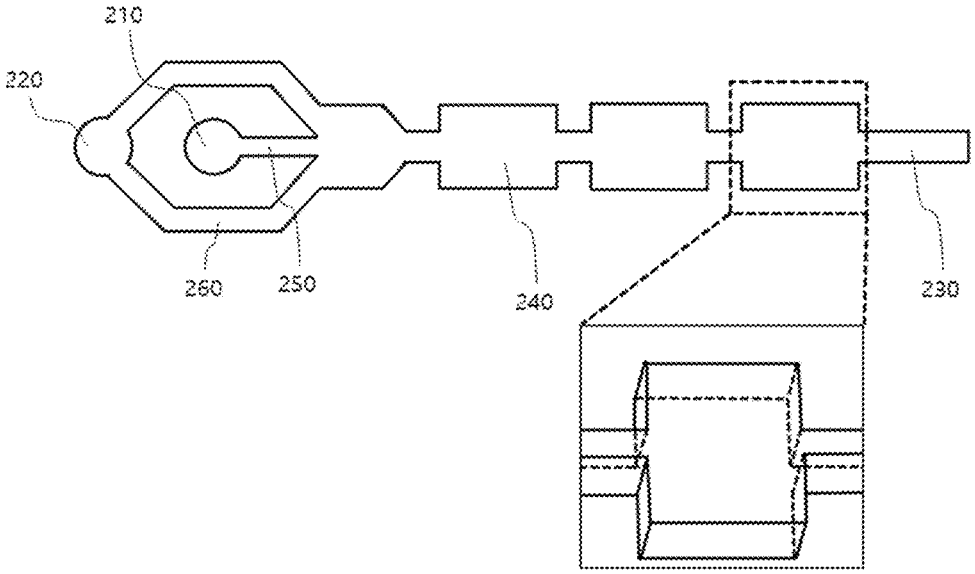
FIG. 3 illustrates microchannel, separating unit, and branched channel portions in the configuration of a microfluidic device according to an exemplary embodiment of the present invention.

FIG. 3 illustrates microchannel, separating unit, and branched channel portions in the configuration of a microfluidic device according to an exemplary embodiment of the present invention.

As illustrated in FIGS. 1 and 3, a microfluidic device 10 according to the present invention includes: the microfluidic mixer 100; a second microchannel 230 with the first outlet 130 of a microfluidic mixer 100 being connected to one side and a second outlet 210 and a third outlet 220 being formed on the other side; and at least two or more separating units 240 disposed between the first outlet 130 and the second outlet 210 and third outlet 220.

As a specific exemplary embodiment, the separating unit 240 is for separating the sample bound in the microfluidic mixer 100 according to size, and includes a space that is wider than the width of the second microchannel 230. Although there is no particular limitation, the separating unit 240 is preferably rectangular.

Due to the continuous arrangement of the separating unit 240, sample particles with different sizes experience different inertial forces, and finally, large sample particles move along the center of the second microchannel 230 and small sample particles move along the side of the second microchannel 230 in different trajectories.

As a specific exemplary embodiment, the length of the second microchannel 230 between the two or more mixing units 240 may be shorter than the length of a width of the mixing unit 240. When the length of the second microchannel 230 between the separating units 240 is longer than the length of a width of the separating unit 240, a pressure drop may occur in the fluid passing through the second microchannel 230 between the separating units 240, and accordingly, the flow in the separating unit 240 is weakened, and thus, the separation efficiency of the sample may deteriorate.

As a specific exemplary embodiment, the second microchannel 230 may be one in which a first branched channel 250 which guides a portion of the sample separated via the separating unit 240 to the second outlet 210 and a second branched channel 260 which guides the other portion of the sample to the third outlet 220 are formed.

In the first branched channel 250 and the second branched channel 260, a branch portion 200 may be branched downstream of a flow channel portion 100 to guide the samples separated from the flow channel portion 100 to different outlets (the second outlet and the third outlet).

As a specific exemplary embodiment, the first branched channel 250 may be provided in a straight line shape, and thus formed such that the center line coincides with the second microchannel 230, and the second branched channel 260 may be formed so as to be inclined in the outward direction of the second microchannel 230.

Specifically, the first branched channel 250 may guide a portion of the samples concentrated at the center in the second microchannel 230, for example, a sample having a relatively large size to the second outlet 210, and may guide the remaining samples of the samples moving to at least one side in the second microchannel 230, for example, a sample having a relatively small size, to the third outlet 220.

For this, the first branched channel 250 may be provided in a straight line shape, and may be formed such that the center line of the first branched channel 250 coincides with the center line of the second microchannel 230, so that the second microchannel 230 and the second outlet 210 provided at the end of the first branched channel 250 may be disposed to be spaced apart from each other on the same line.

In contrast, the second branched channel 260 may include a portion formed so as to be inclined from the downstream of the second microchannel 230 to the outside of the second microchannel 230, a portion formed straight, and a portion formed so as to be inclined toward the third outlet 220 disposed on the same line as the second outlet 210, along the flow direction of a non-Newtonian fluid or sample.

In particular, as illustrated in FIG. 3, when two second branched channels 260 are provided, the first branched channel 250 may be disposed between the two second branched channels 260. Moreover, the two second branched channels 260 are formed symmetrically with each other with the first branched channel 250 therebetween, and thus, may be combined at the third outlet 220.

Further, the width of the first branched channel 250 may be formed to be narrower than the width of the second microchannel 230, whereas the width of the second branched channel 260 may be formed to be wider than the width of the second microchannel 230. Moreover, the length of the first branched channel 250 may be formed to be shorter than the length of the second microchannel 230, and the length of the second branched channel 260 may be formed to be longer than the length of the first branched channel 250.

A portion of the samples concentrated at the center in the second microchannel 230, for example, a sample having a relatively large size may be relatively rapidly collected or concentrated in the second outlet 210, and the remaining samples of the samples moving to at least one side in the second microchannel 230, for example, a sample having a relatively small size may be relatively slowly collected in the third outlet 220, and then discharged outside.

Additionally, by providing a suction flow to the second outlet 210, it is possible to improve the concentration proportion of the sample collected in the first outlet 210, for example, a sample having a relatively large size, Meanwhile, the microfluidic device according to the present invention may be utilized for a bioinformation analysis method for capturing a target material included in the body Epithelial to mesenchymal transition (EMT) means a transition from epithelial cell properties to mesenchymal cell properties, and EMT-related reprogramming of cells is closely related not only to changes in various regulatory networks, but also to close interactions between these networks.

Figure 4:
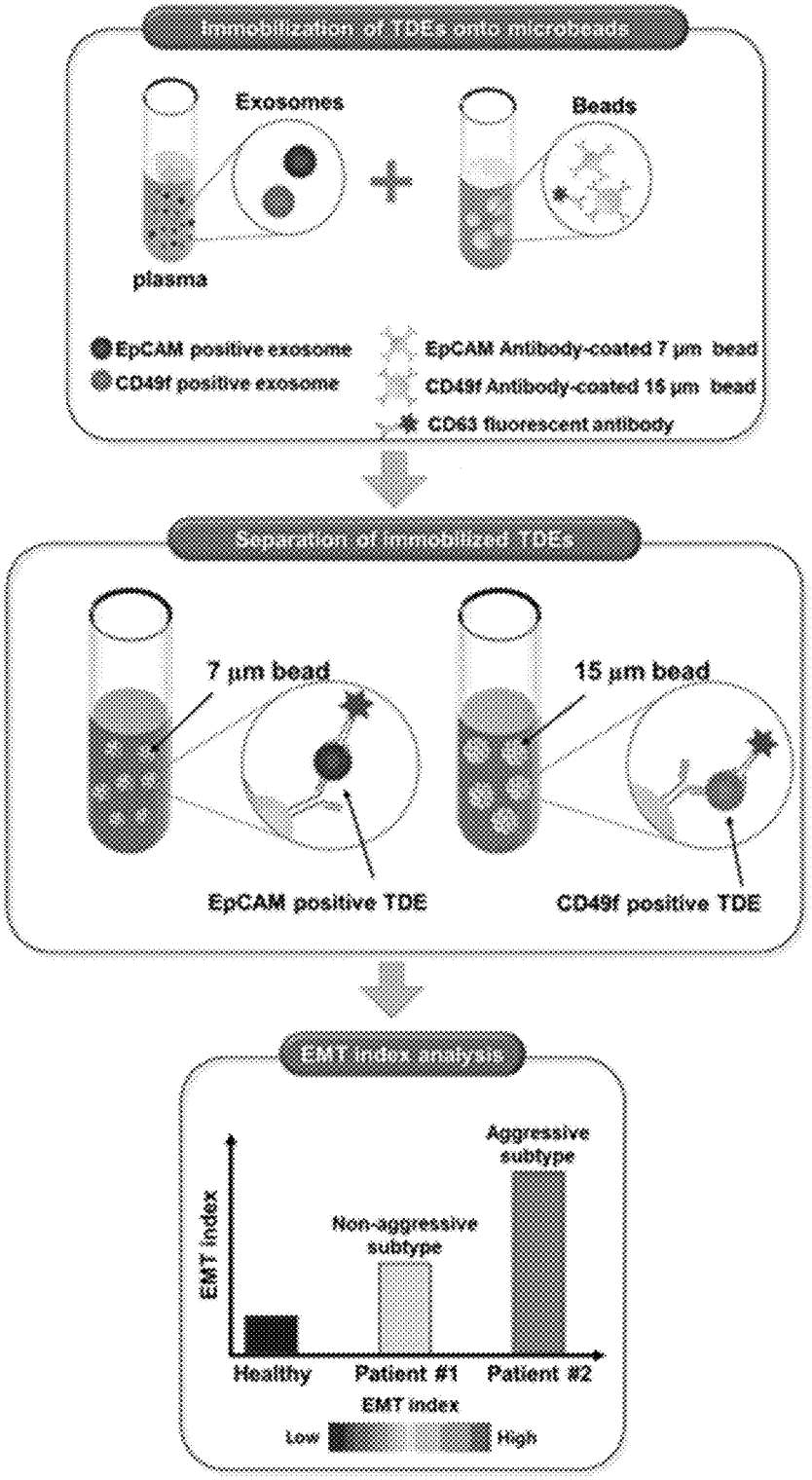
FIG. 4 exemplarily illustrates a method of using EpCAM and CD49f antibodies as markers to bind them to beads with different sizes, and then separate and analyze them in order to predict the early diagnosis and prognosis of patients with cancer.

Since CD49f and EpCAM on the cell surface have EMT characteristics using stem cell markers. EpCAM and CD49f antibodies are used as markers to bind these antibodies to beads with different sizes, and then the early diagnosis and prognosis of patients with cancer may be predicted by separating and analyzing the antibodies, as illustrated in FIG. 4.

Figure 5:
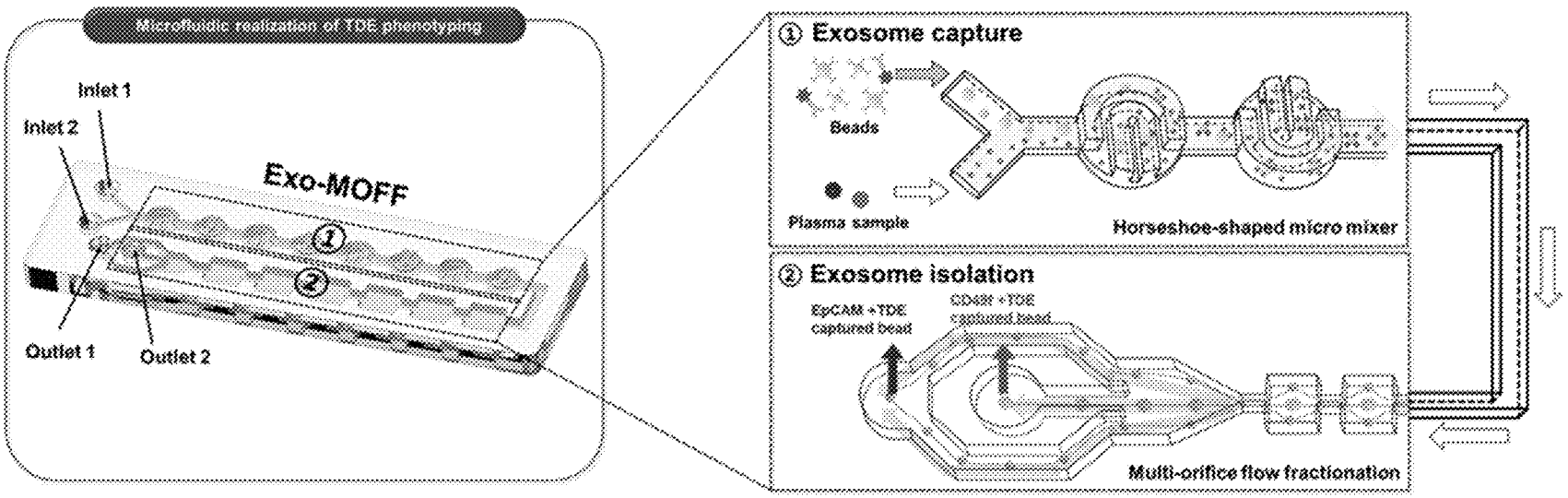
FIG. 5 exemplarily illustrates the process of separating and concentrating exosomes, which are a target material, using the microfluidic device according to the present invention as an exemplary embodiment.

As illustrated in FIG. 5, when 7 μm beads bound to the EpCAM antibody and 15 μm beads bound to the CD49f antibody are injected into the first inlet 100 and an exosome sample is injected into the second inlet 120 by a syringe pump in the microfluidic device according to the present invention as an exemplary embodiment, the injected exosomes will bind to the antibody on the bead surface while passing through the microfluidic mixer 100. Bound exosomes move to the separating unit 240 via the second microchannel 230, 15 μm beads, which are relatively large, move along the center of the second microchannel 230, and thus are separated into the second outlet 210, and 7 μm, which are relatively small, are separated into both sides, and thus are separated into the third outlet 220, so that exosomes expressing different surface proteins can be separated and concentrated.

Figure 6:
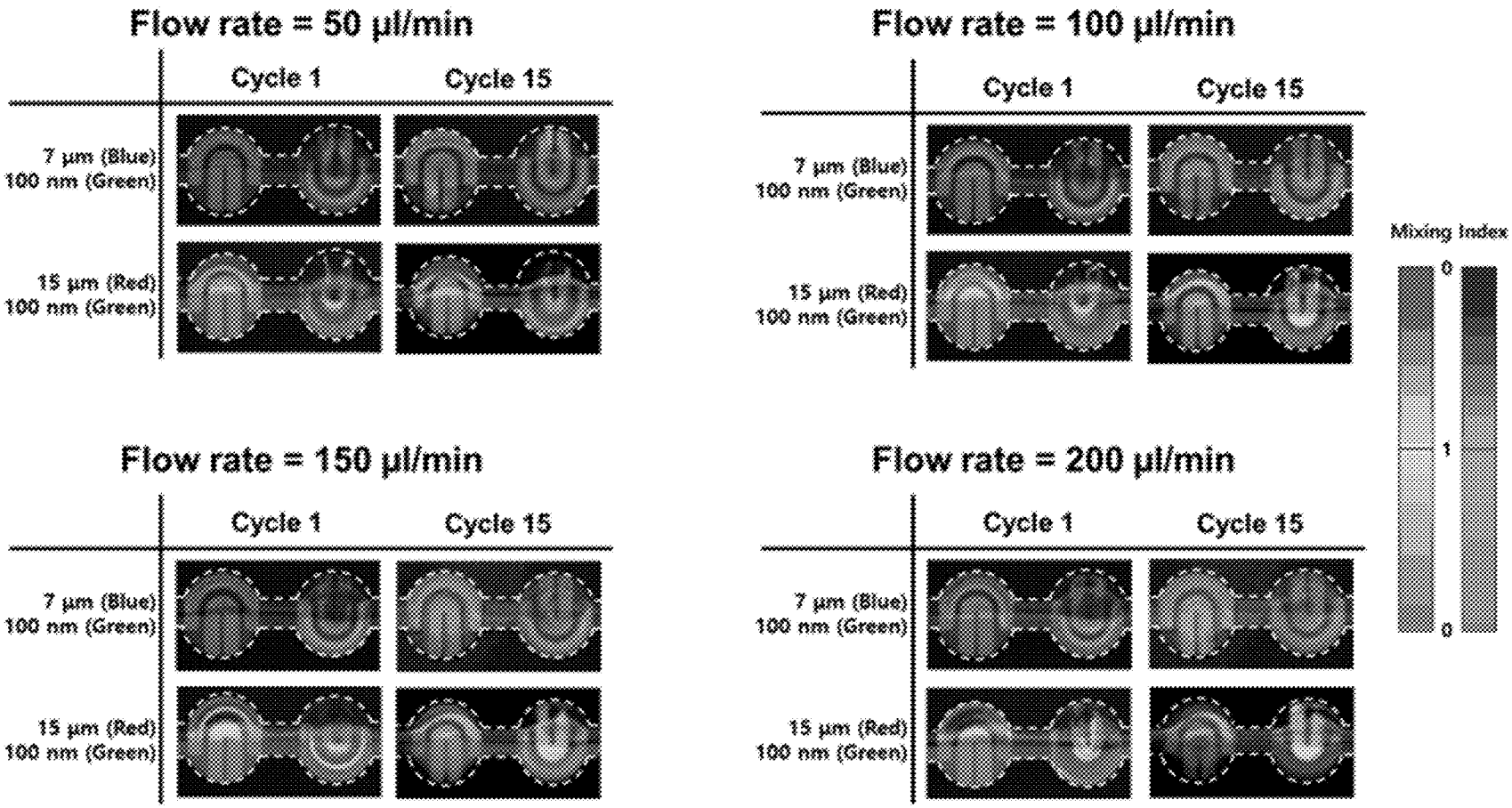
FIG. 6 is a set of images that capture fluorescence generated by injecting fluorescent particles in order to evaluate the particle mixing efficiency of the microfluidic mixer according to the present invention.

FIG. 6 is a set of images that capture fluorescence generated by injecting fluorescent particles in order to evaluate the particle mixing efficiency of the microfluidic mixer according to the present invention.

Figure 7:
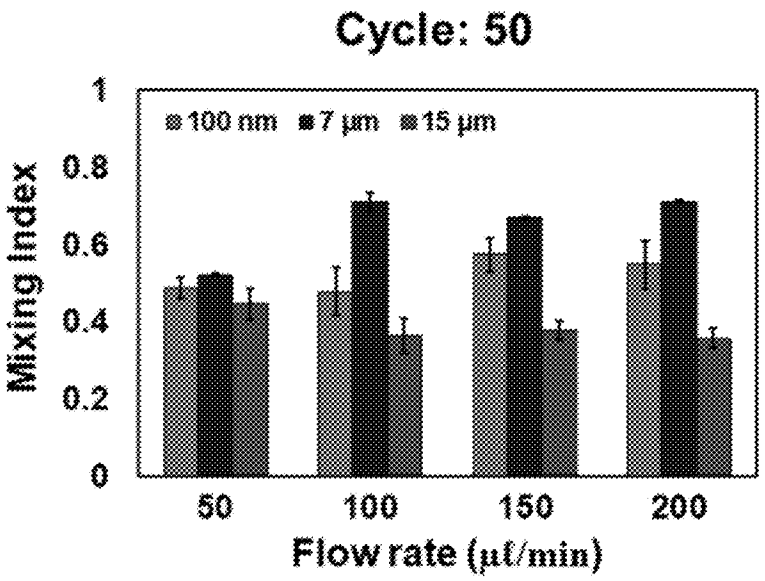
FIG. 7 is a graph showing the mixing index (MI) values calculated by analyzing fluorescent image pixels in order to confirm the degree to which two types of particles are mixed.
Figure 7:
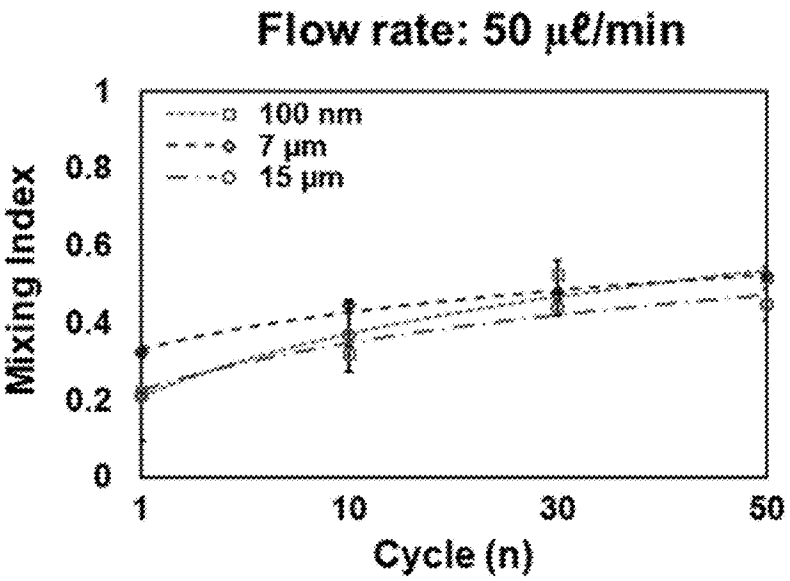

FIG. 7 is a graph showing the mixing index (MI) values calculated by analyzing fluorescent image pixels in order to confirm the degree to which two types of particles are mixed.

100 nm green fluorescent particles and 7 μm blue and 15 μm red fluorescent particles were injected into the microfluidic mixer according to the present invention, and the mixing efficiency was measured at a flow rate of 50 to 200 μl/min.

The MI range is between 0 and 1, and has a value of 1 when the particles are perfectly mixed. It can be confirmed that the MI value of 100 nm and 7 μm particles increases as the cycle increases from 1 to 15 over the entire flow rate range. It can be seen that the MI value of 15 μm particles decreases at a flow rate of 200 μl/min. In a microfluidic channel environment, as the particle size increases, the particle experiences more inertial force, and as the flow rate increases, the force experienced by the particle increases with the square root. The flow rate range that may be used in the microfluidic mixer of the present invention is 50 to 150 μl/min.

Figure 8:
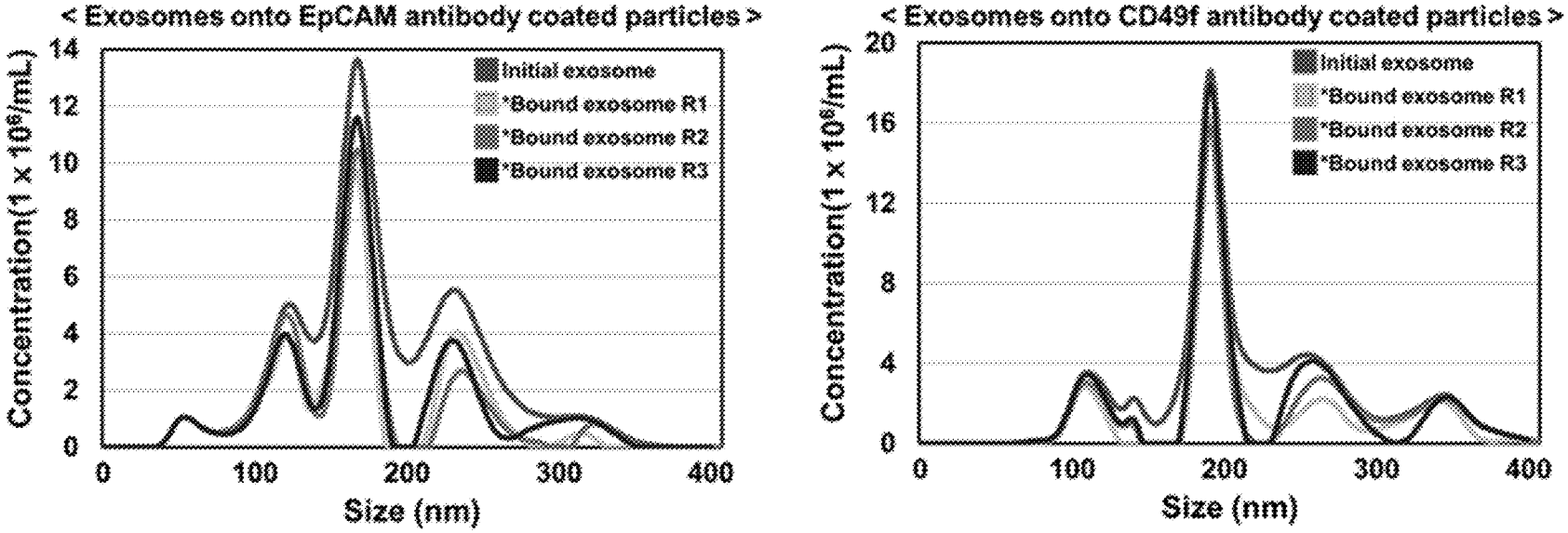
FIG. 8 illustrates the results of measuring the binding efficiency of antibody-coated beads and exosomes using the microfluidic mixer according to the present invention.
Figure 9:
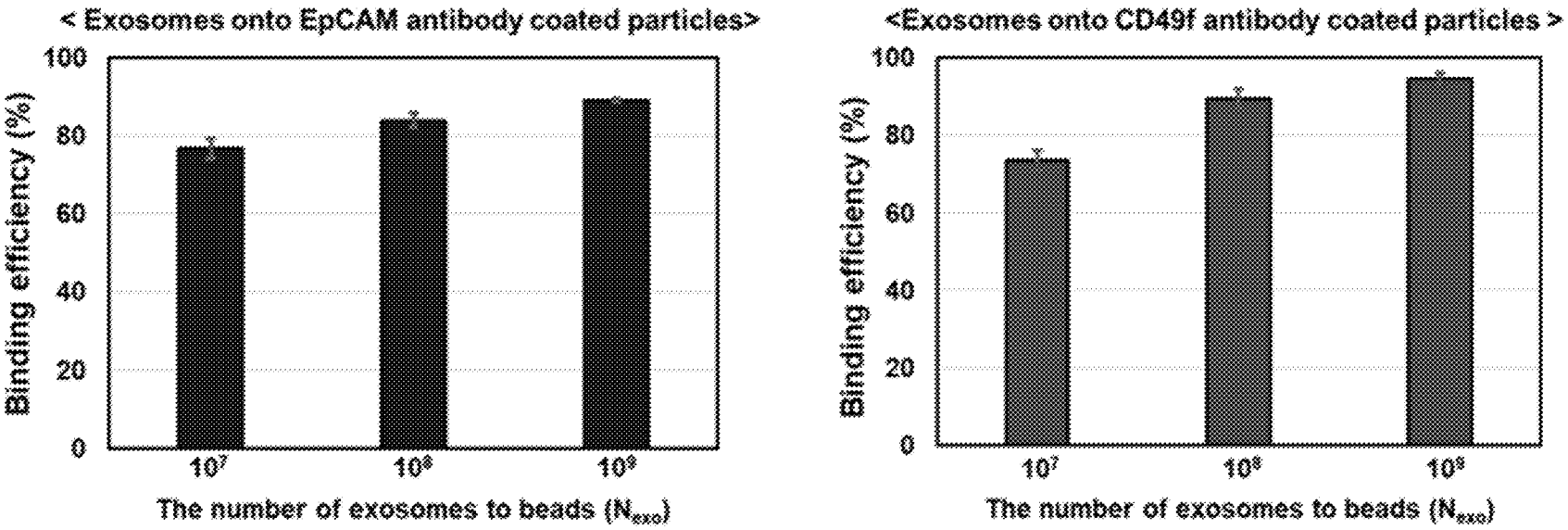
FIG. 9 illustrates the results of calculating the number of bound exosomes per bead in order to measure the binding efficiency of antibody-coated beads and exosomes using the microfluidic mixer according to the present invention.

FIG. 8 illustrates the results of measuring the binding efficiency of antibody-coated beads and exosomes using the microfluidic mixer according to the present invention. FIG. 9 illustrates the results of calculating the number of bound exosomes per bead in order to measure the binding efficiency of antibody-coated beads and exosomes using the microfluidic mixer according to the present invention. In order to confirm the binding efficiency of exosomes and beads in the microfluidic mixer according to the present invention, an antibody-coated bead binding experiment was performed using exosomes derived from a cell line. The experiment was performed by extracting exosomes from SK-BR-3, which is a cell line with high EpCAM expression, and MDA-MB-231, which is a cell line with high CD49f expression. The initial concentrations and sizes of exosomes with high EpCAM and CD49f expression were measured using a nanoparticle tracking analyzer (NTA). The maximum number of exosomes which can be captured per microbead is defined as $N_{exo}$, and the calculation formula is as follows [Equation 1].

$$N_{exo}=SA_{bead}/CS_{exo} \quad \text{[Equation 1]}$$

In [Equation 1], an exosome surface cross-sectional area ($CS_{exo}$) is 2rπ2 (NTA measurement average diameter: 200 nm), and a bead surface area ($SA_{bead}$) is 4πr2 (bead diameter: 7 μm, 15 μm). Based on the number of exosomes $10^9$, the number of beads was set in a range of $N_{exo}=10^9$, $10^8$, and $10^7$. EpCAM antibody-coated 7 μm beads and EpCAM-expressing exosomes were allowed to pass through the microfluidic mixer according to the present invention at a flow rate of 150 μl/min, and the exosomes bound to the beads were calculated by measuring the exosomes remaining after the experiment by NTA. Experiments were also performed on CD49f-coated 15 μm beads and CD49f-expressing exosomes in the same manner. As illustrated in FIG. 9, the EpCAM-expressing exosomes had the highest binding efficiency of 89.99% when $N_{exo}$ was $10^9$. The CD49f-expressing exosomes also had the highest binding efficiency of 94.63% when $N_{exo}=10^9$.

Figure 10:
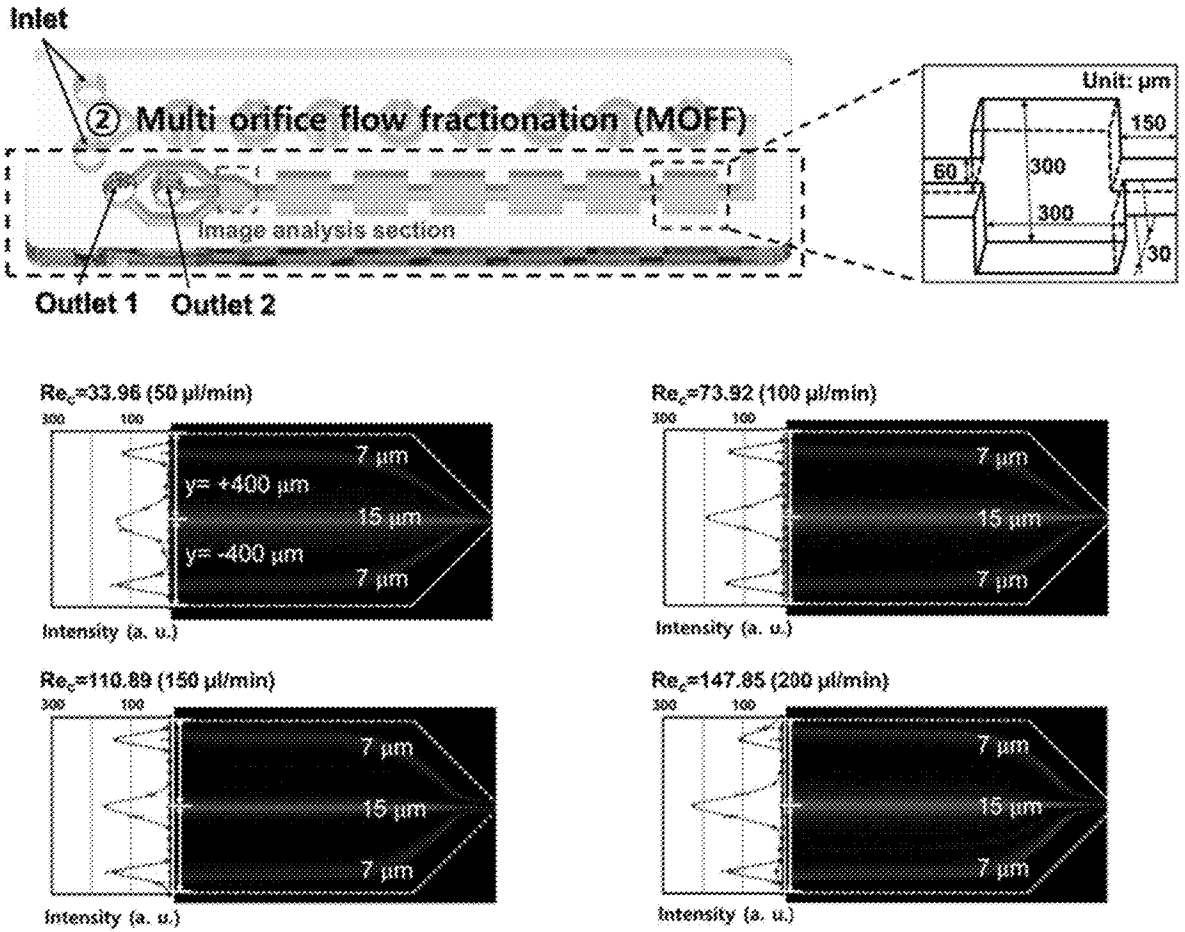
FIG. 10 illustrates the results of confirming the moving position of each particle in order to evaluate the separation efficiency by the size of the particles (microbeads) in a second microchannel 230 and a separating unit 240 of a microfluidic device 10 according to the present invention using fluorescent particles.

FIG. 10 illustrates the results of confirming the moving position of each particle through a fluorescence experiment in order to evaluate the separation efficiency by the size of the particles (microbeads) in a second microchannel 230 and a separating unit 240 of a microfluidic device 10 according to the present invention using fluorescent particles. The fluorescence experiment was performed by making a change in the dimensionless Reynolds number (Re) value, which is a ratio of inertial force to viscous force. The formula is as follows [Equation 2].

$$Re=\rho Vd/\mu \quad \text{[Equation 2]}$$

In [Equation 2], ρ is the density of a fluid, μ is the viscosity of the fluid, V is a maximum flow rate, and d is a hydraulic length. The experiment was performed while varying flow rate and viscosity. As illustrated in FIG. 10, it can be confirmed that the 15 μm beads with large particles are arranged in the center at all flow rates, and the position of the 7 μm bead changes from the outside to the inside as the Re value increases.

Figure 11:
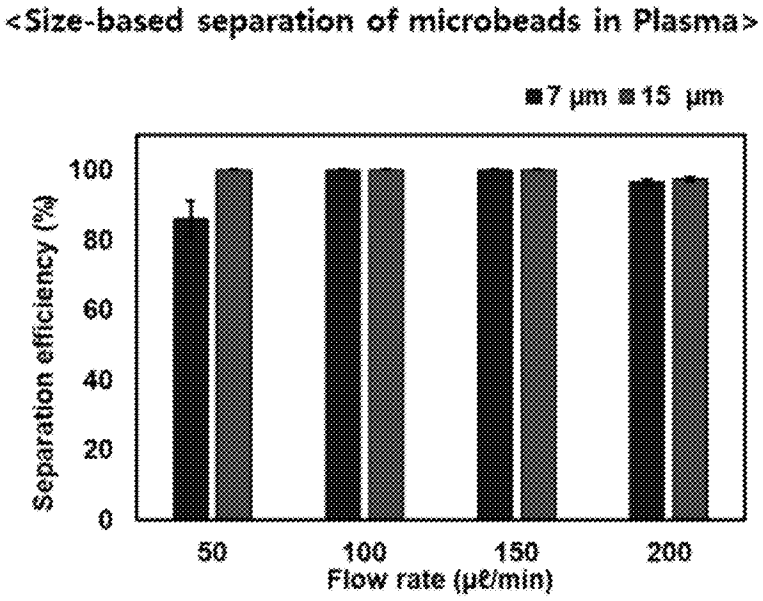
FIG. 11 illustrates the results of evaluating the separation efficiency of an actual sample according to the size of the particles (microbeads) in the second microchannel 230 and the separating unit 240 of the microfluidic device 10 according to the present invention.
Figure 11:
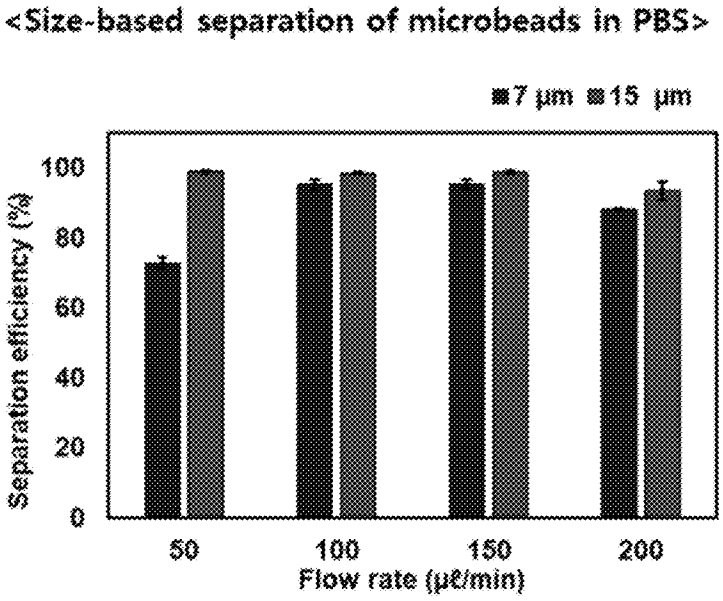

FIG. 11 illustrates the results of evaluating the separation efficiency of an actual sample according to the size of the particles (microbeads) in the second microchannel 230 and the separating unit 240 of the microfluidic device 10 according to the present invention.

In order to confirm the bead separation efficiency in an actual sample, beads to which an antibody used in the actual sample was bound were used, and an experiment was performed using phosphate buffered saline (PBS), which is similar to the components of human body fluids, and an actual plasma solution. As illustrated in FIG. 11, it was confirmed that both the PBS solution and the serum had the highest separation efficiency at a flow rate of 150 μl/min.

FIG. 12 shows the results of verifying the separation and concentration efficiency of the microfluidic device according to the present invention using exosomes extracted from cell lines and actual patient plasma for isolation and concentration of exosomes derived from cancer.

In order to confirm the separation efficiency of EpCAM and CD49f, beads with different sizes, whose surface was coated with an antibody capable of capturing the exosomes were injected into a microfluidic device 10. Culture solutions of MCF-7 and SK-BR-3, which are cell lines with high EpCAM expression, and MDA-MB-231 and Hs578T, which are cell lines with high CD49f expression, were used, and EpCAM-positive (EpCAM+) exosomes and CD49f-positive (CD49f+) exosomes were used. At the same time, in order to compare the separation and concentration efficiencies of the microfluidic device 10 according to the present invention, exosomes were also separated by a precipitation method using polyethylene glycol among conventionally used exosome separation methods. For the separated exosomes, the relative expression levels of EpCAM and CD49f compared to CD63 mRNA, which represents the entire exosomes, were verified using real-time PCR using a target specific pre-amplification method.

Figure 12A:
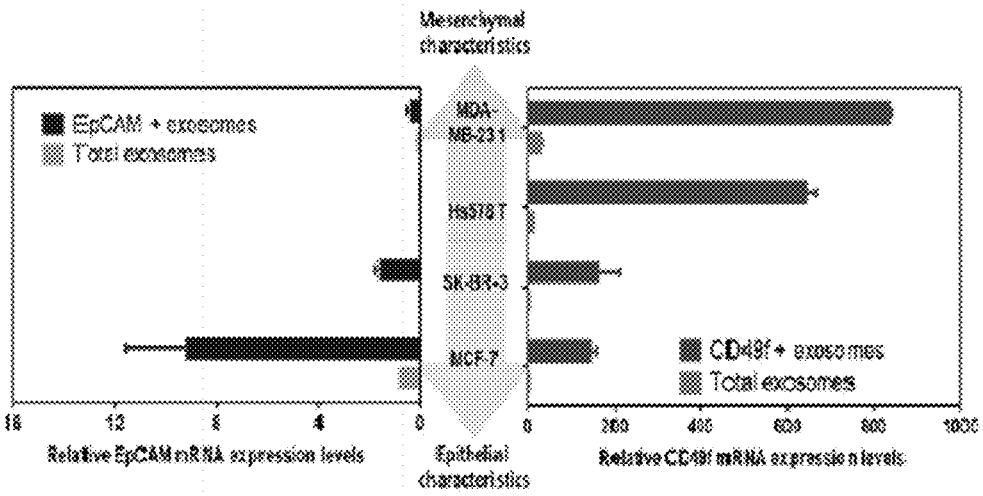
FIGS. 12A and 12B show the results of verifying the separation and concentration efficiency of the microfluidic device according to the present invention using exosomes extracted from cell lines and actual patient plasma for separation and concentration of exosomes derived from cancer.
Figure 12B:
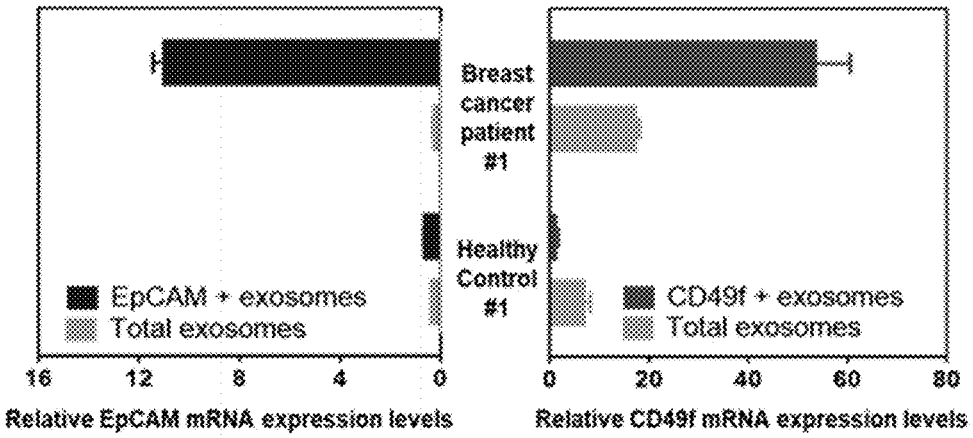

As illustrated in FIG. 12, it was revealed that the EpCAM mRNA level in the exosomes separated by the microfluidic device 10 according to the present invention was 15.7-fold higher on average than that in the exosomes separated by the precipitation method. Likewise, the CD49f mRNA level in exosomes separated by the microfluidic device 10 was found to be 40-fold higher on average than that in exosomes separated by the precipitation method (FIG. 12A). The separation efficiencies when a method using the microfluidic device 10 and the precipitation method were used were evaluated using 100 μl of plasma of each of a healthy control and patients with breast cancer. In the case of patients with breast cancer, the microfluidic device 10 was found to have significantly higher expression of EpCAM and CD49f mRNA than a precipitation-based separation method (FIG. 12B). Since EpCAM is known as a tumor-specific marker and the expression thereof is low under normal conditions, the level of EpCAM in the healthy control was found to be low in both methods as expected.

From this, it can be seen that the method using the microfluidic device 10 according to the present invention can separate and concentrate EpCAM and CD49f-expressing exosomes more efficiently than the precipitation method.

In the microfluidic mixer according to the present invention, a disk-shaped mixing unit with double U-shaped protruding portions formed therein can be continuously provided along a microchannel, thereby increasing collisions of samples to improve the binding efficiency thereof and shorten the binding time. Furthermore, the microfluidic device according to the present invention can detect a target material at high speed even at a high flow rate by including the microfluidic mixer, and thus can be usefully utilized for early diagnosis and prognosis diagnosis of a disease such as cancer.

The above-described description of the present invention is provided for illustrative purposes, and those skilled in the art to which the present invention pertains will understand that the present invention can be easily modified into other specific forms without changing the technical spirit or essential features of the present invention. Therefore, it should be understood that the above-described embodiments are only exemplary in all aspects and are not restrictive.

What is claimed is:

1. A microfluidic mixer comprising:

a first microchannel with a first inlet and a second inlet, through which a fluid is introduced, being formed on one end of the first microchannel and a first outlet, through which the fluid is discharged, being formed on another end of the first microchannel; and at least two disk-shaped mixing units disposed between the first inlet and second inlet and the first outlet, the at least two disk-shaped mixing units including a U-shaped first protruding portion and a U-shaped second protruding portion, wherein the U-shaped first protruding portion is disposed inside the U-shaped second protruding portion, wherein each of the at least two disk-shaped mixing united has a two-layer structure with a lower portion and an upper portion, and wherein the lower portion of each of the at least two disk-shaped mixing units is formed as a disk-shaped space and the U-shaped first and second protruding portions are formed in the upper portion.

2. The microfluidic mixer of claim 1, wherein the mixing unit is disposed such that a curved portion of the U-shaped first protruding portion and a curved portion of the U-shaped second protruding portion each extend through an angle of 10 to 170° with respect to a direction in which the first microchannel extends.

3. The microfluidic mixer of claim 1, wherein the U-shaped first protruding portion and the U-shaped second protruding portion in adjacent mixing units of the at least two mixing units face in opposite directions.

4. The microfluidic mixer of claim 1, wherein a length of the first microchannel between adjacent disk-shaped mixing units of the at least two disk-shaped mixing units is shorter than a diameter of each of the at least two disk-shaped mixing units.

5. A microfluidic device comprising:

the microfluidic mixer of claim 1;

a second microchannel with the first outlet of the microfluidic mixer being connected to one end of the second microchannel and a second outlet and a third outlet being formed on another end of the second microchannel; and at least two separating units disposed between the first outlet and the second outlet and third outlet.

6. The microfluidic device of claim 5, wherein the at least two separating units are rectangular.

7. The microfluidic device of claim 5, wherein a length of the second microchannel between adjacent separating units of the at least two separating units is shorter than a length of a width of each of the at least two separating units.

8. The microfluidic device of claim 5, wherein the second microchannel includes a first branched channel which guides a portion of a sample separated via one of the at least two separating units to the second outlet and a second branched channel which guides the other portion of the sample to the third outlet.

9. The microfluidic device of claim 8, wherein the first branched channel is provided in a straight line shape and is positioned along an axis that is the same axis as the second microchannel, and the second branched channel is formed so as to be inclined in the outward direction of the second microchannel.

10. A bioinformation analysis method for capturing a target material comprised in a body using the microfluidic device of claim 5, the method comprising:

injecting antibodies into the first inlet;

injecting exosomes into the second inlet, wherein the exosomes bind to the antibodies on one of a larger bead or a smaller bead, wherein bound exosomes on the larger bead move along a center of the second microchannel into a first branched channel to the second outlet, and wherein the bound exosomes on the smaller bead move into a second branched channel to the third outlet.

* * * * *